US006378405B1

(12) United States Patent
Miller et al.

(10) Patent No.: US 6,378,405 B1
(45) Date of Patent: Apr. 30, 2002

(54) TOOL FOR ANTI-TAMPERING DEVICES

(75) Inventors: Glenn G. Miller, Lewisburg; Roger M. Losinger, Liberty, both of PA (US)

(73) Assignee: LEMCO Tool Corp., Cogan Station, PA (US)

( * ) Notice: Subject to any disclaimer, the term of this patent is extended or adjusted under 35 U.S.C. 154(b) by 0 days.

(21) Appl. No.: 09/630,113

(22) Filed: Aug. 1, 2000

(51) Int. Cl.[7] ..... B25B 15/00; B25B 23/10
(52) U.S. Cl. ..... 81/444; 81/448; 81/176.15
(58) Field of Search ..... 81/436, 442–444, 81/448–449, 176.1–176.3, 177.85

(56) References Cited

U.S. PATENT DOCUMENTS 3,033,016 A * 5/1962 Mosberg ..... 81/444
3,172,282 A 3/1965 Heckrotte
4,291,599 A * 9/1981 Heckrotte, Sr. ..... 81/444
6,044,730 A * 4/2000 Roberts et al. ..... 81/177.85

* cited by examiner

*Primary Examiner*—D. S. Meislin
(74) *Attorney, Agent, or Firm*—John J. Elnitski, Jr.

(57) ABSTRACT

The present invention is a tool (40) for use with anti-tampering devices. The tool resists jamming, simplifies use and has less complicated parts to produce. The tool includes a handle, shaft, spring, activation plunger and ball. The shaft extends from the handle. The shaft includes a cavity in the shaft having an open end at the bottom end of the shaft. The shaft includes a ball hole on the shaft within an area of the cavity. The spring is located in the cavity. The activation plunger extends from the bottom end of the shaft. The ball is located in the cavity, whereby the ball is positioned to be extendible out the ball hole.

11 Claims, 10 Drawing Sheets

TOOL FOR ANTI-TAMPERING DEVICES

BACKGROUND

FIGS. 1–4 show examples of different anti-tampering devices. FIG. 1 shows a cable signal terminator 10 and FIG. 3 shows a locking device 12. Each anti-tampering device 10, 12 has an engagement means 14 shown in FIGS. 2 and 4, which rotates to add or remove the anti-tampering device 10, 12. The engagement means 14 includes a head 16 and a body 18 connected to the head 16. The body 18 engages the other components of the anti-tampering devices 10, 12. These other components can include parts that are on the object in which the anti-tampering device is attached. The head 16 is used to rotate the body 18. The head 16 includes a socket to insert a tool and a hole 22 on the side of head 16 which passes thru to the area of the socket. A prior art tool 24 used to turn the head 16 of the anti-tampering devices 10, 12 is shown in FIG. 5. It includes a handle 26, a push rod 28 extending from the top of the handle 26 and a shaft 30 extending from the bottom of the handle 26. The shaft 30 is hollow and includes a hole 32 on the side of the shaft 30 and a ball 34 trapped inside the shaft 30. The push rod 28 extends thru the handle 26 and into the shaft 30. When the push rod 28 is forced downward, it forces the ball 34 into the hole 32, such that a portion of the ball 34 extends outward from the hole 32. Pulling back on the push rod 28 at the top of the handle 26 releases the ball 34 and allows the ball 34 to fall away from the hole 32. The tool 24 is used by pulling back on the push rod 28 and inserting the end of the shaft 30 opposite the handle 26 into the socket of the head 16. The push rod 28 is depressed to force the ball 34 into the hole 32 of the shaft 30, while the tool 24 is rotated. As the tool 24 is rotated, the portion of the ball 34 extending from the hole 32 of the shaft 30 will engage the hole 22 in the head 16. When the ball 34 engages the hole 22 in the head 16, the tool 24 and the head 16 are engaged, such that the head 16 rotates as the tool 24 is rotated. The tool 24 and engagement means 14 is a good system to prevent the removal of the anti-tampering devices 10, 12, but the system has some drawbacks due to the prior art tool 24. The drawbacks are that the ball 34 can jam in the hole 32 of the shaft 30, if too much force is applied to the push rod 28, or the push rod 28, itself, can jam in the shaft 30.

It is an object of the present invention to provide a tool that resists jamming, simplifies use as compared to the prior art tool, simplifies manufacturing as compared to the prior art tool and reduces cost of manufacture.

SUMMARY OF THE INVENTION

The present invention is a tool for use with anti-tampering devices. The tool includes a handle, shaft, spring, activation plunger and ball. The shaft extends from the handle. The shaft includes a cavity in the shaft having an open end at the bottom end of the shaft. The shaft includes a ball hole on the shaft within an area of the cavity. The spring is located in the cavity. The activation plunger extends from the bottom end of the shaft. The ball is located in the cavity, whereby the ball is positioned to be extendible out the ball hole.

DETAILED DESCRIPTION OF THE INVENTION

Figure 1:
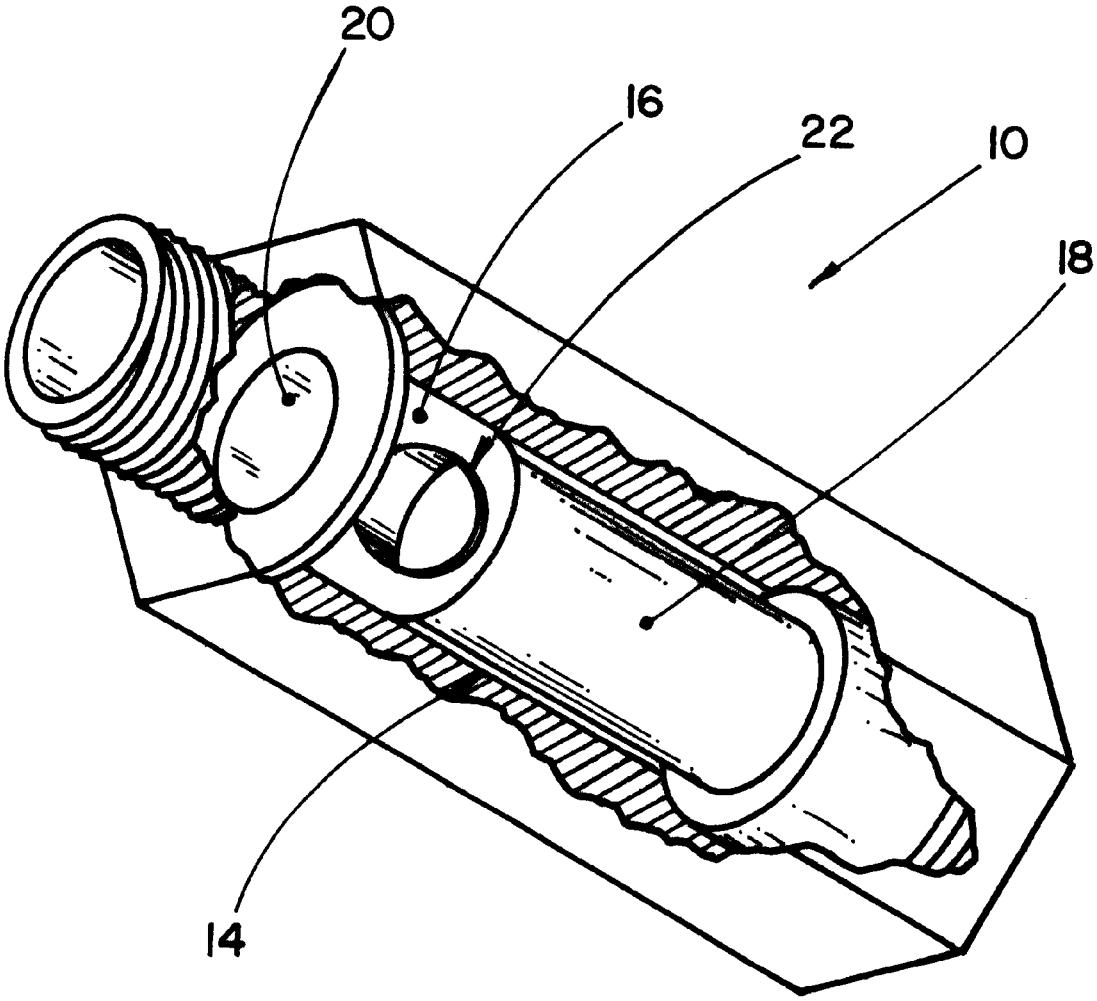
FIG. 1 is a perspective cut-a-way view of a anti-tampering device.
Figure 2:
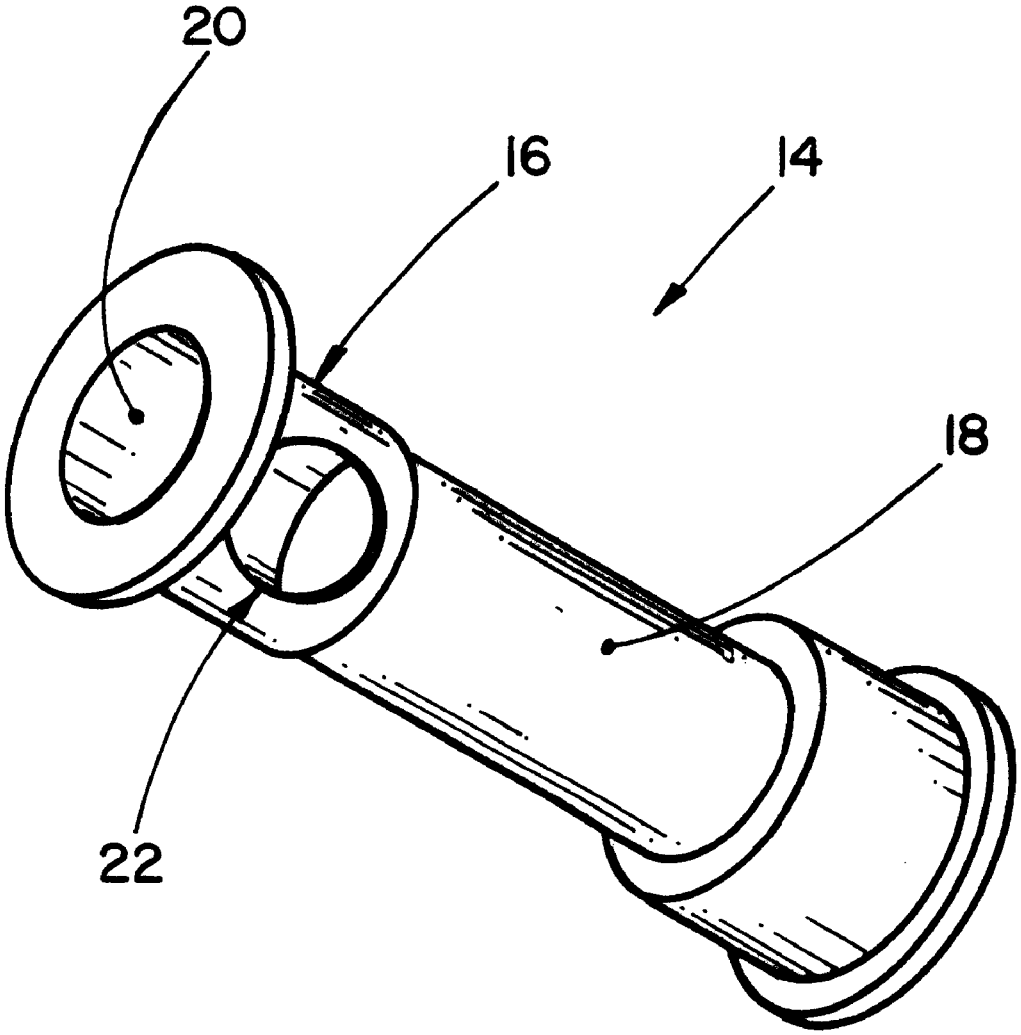
FIG. 2 is a perspective view of an engagement means of the anti-tampering device of FIG. 1.
Figure 3:
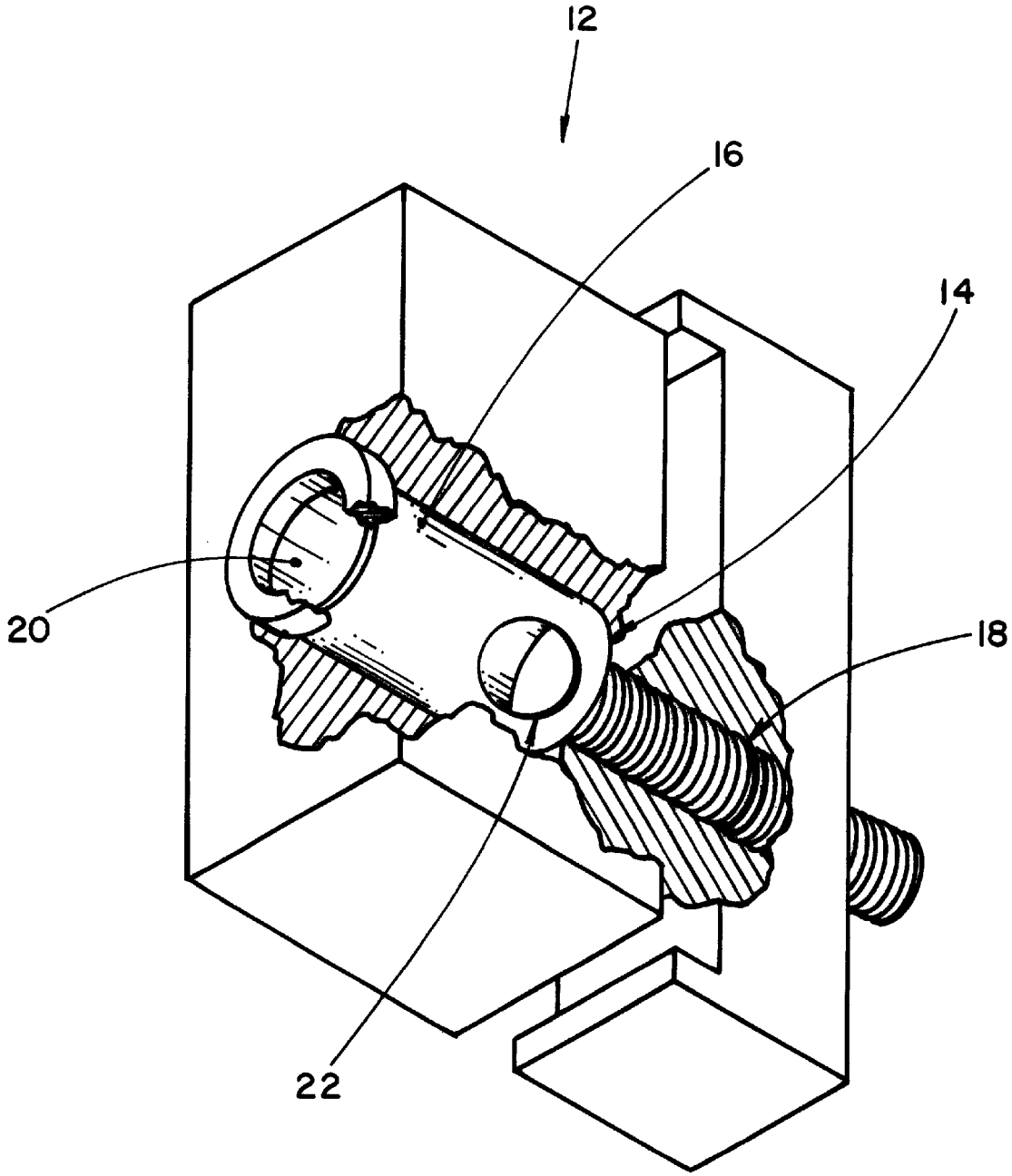
FIG. 3 is a perspective cut-a-way view of another anti-tamnpering device.
Figure 4:
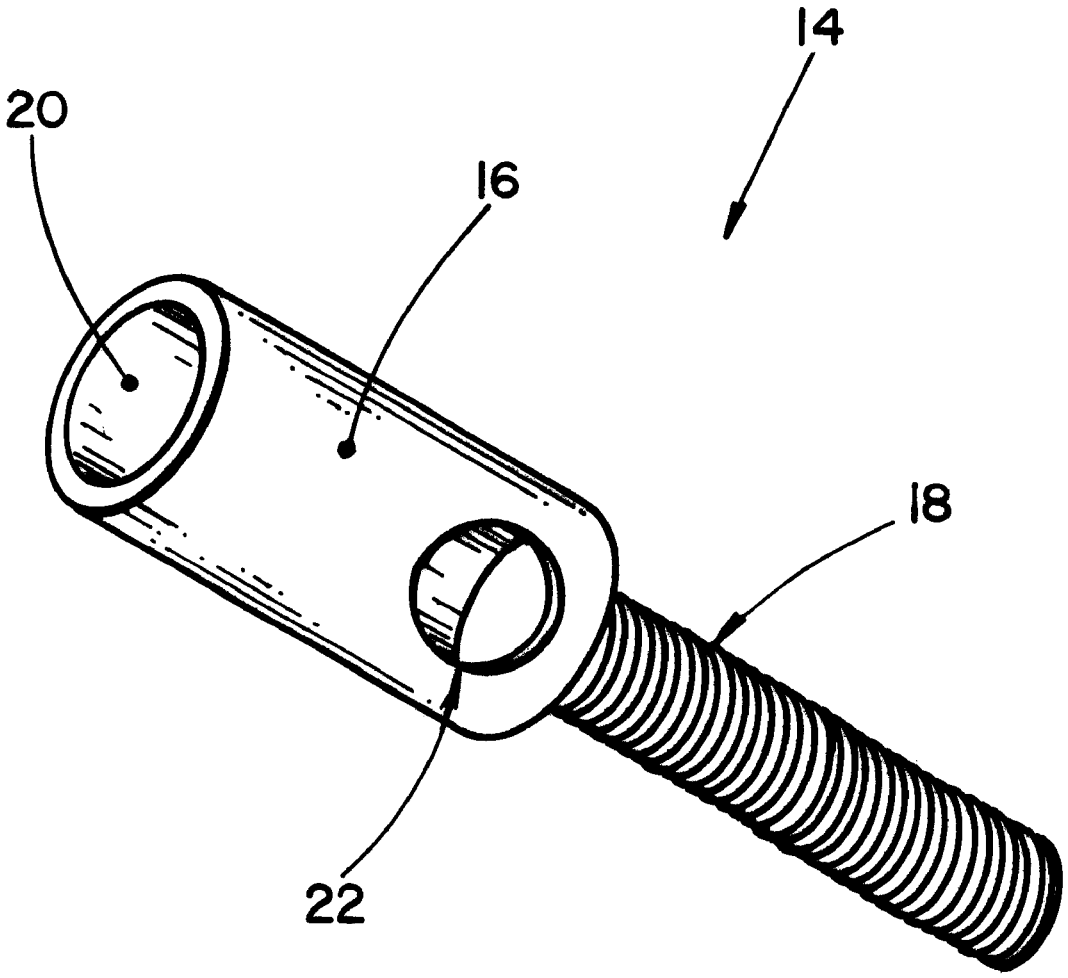
FIG. 4 is a perspective view of an engagement means of the anti-tampering device of FIG. 2.
Figure 5:
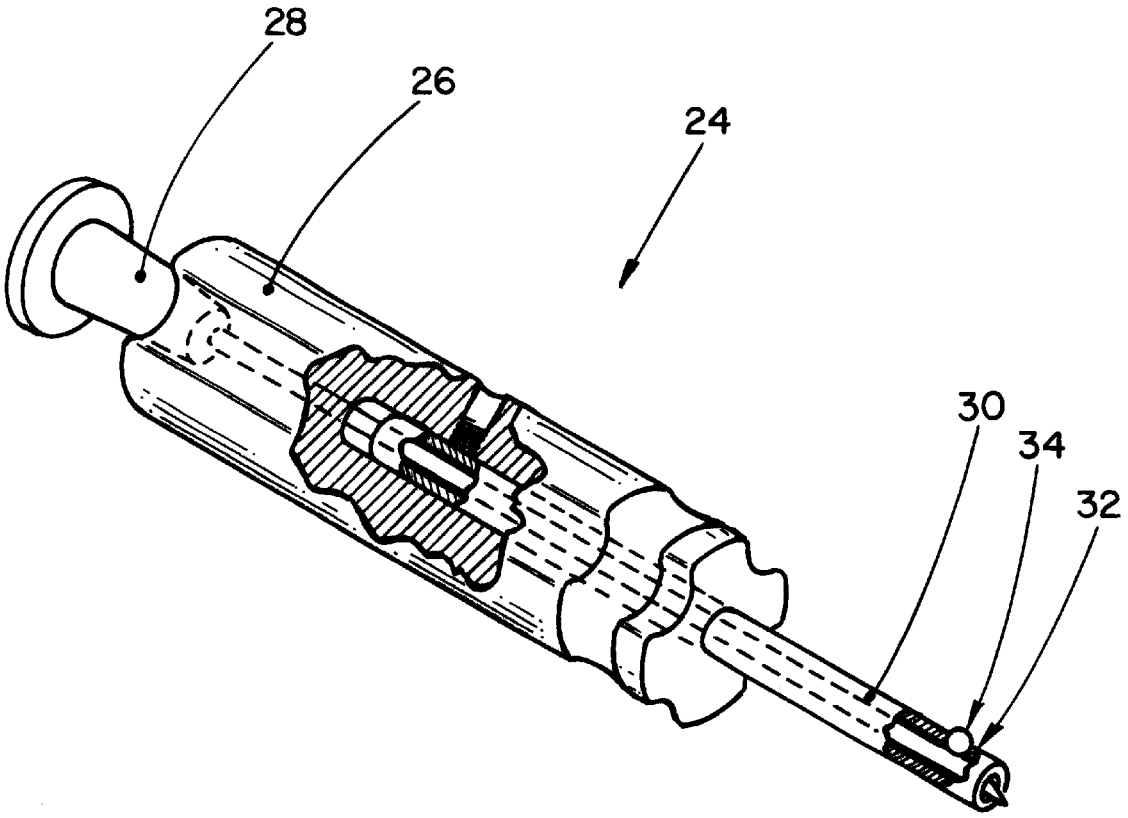
PRIOR ART FIG.5
FIG. 5 is a perspective cut-a-way view of a prior art tool.
Figure 6:
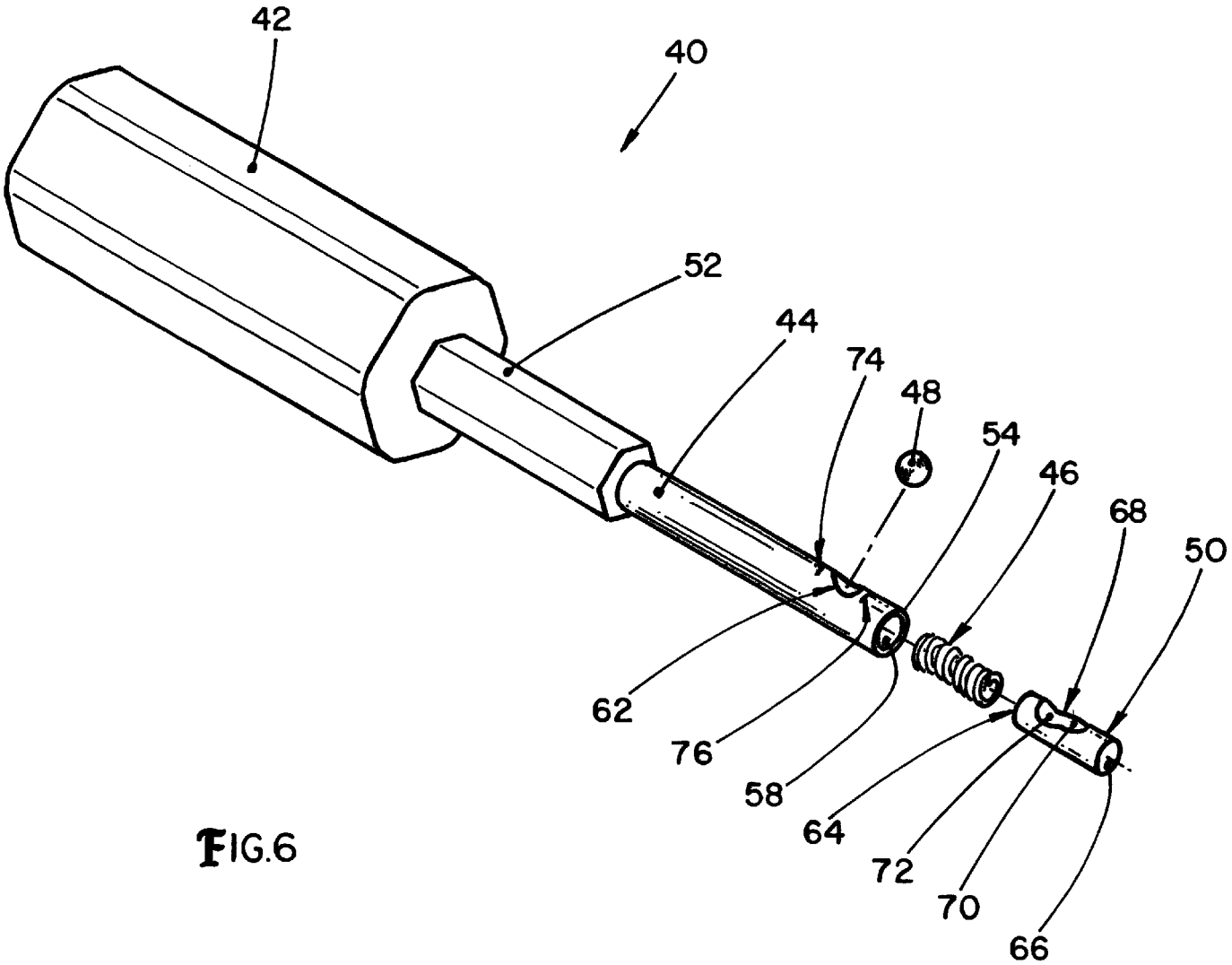
FIG. 6 is a perspective cut-a-way view of a tool according to the present invention.
Figure 7:
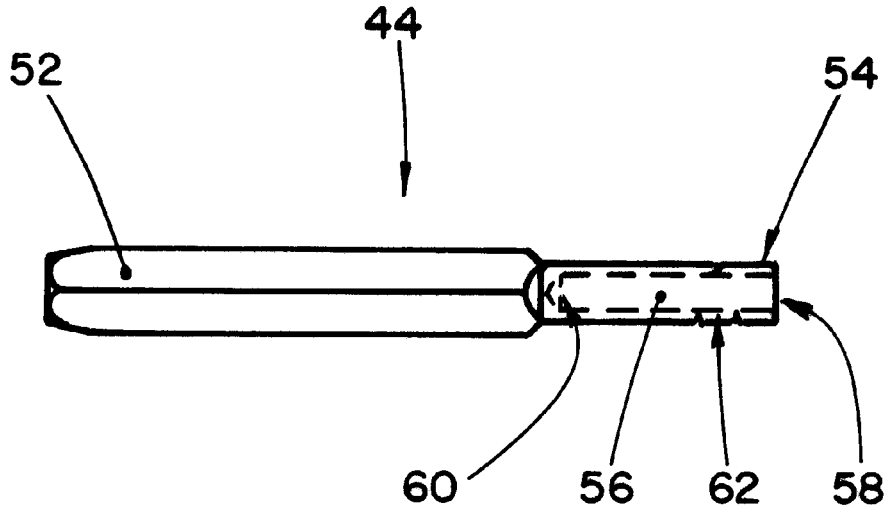
FIG. 7 is a side view of a shaft of the tool according to the present invention.
Figure 8:
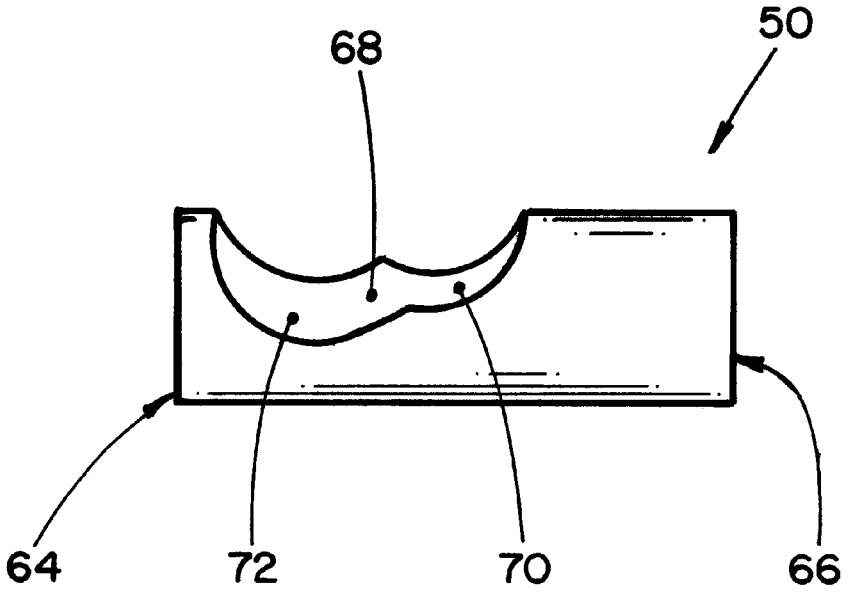
FIG. 8 is a side view of an activation plunger of the tool according to the present invention.

The present invention is a tool 40 for use with anti-tampering devices 10, 12. The tool 40 resists jamming, simplifies use and has less complicated parts to produce. The tool 40 includes a handle 42, shaft 44, spring 46, ball 48 and an activation plunger 50, as shown in FIG. 6. The shaft 44 has a top end 52 and a bottom end 54. As shown in FIG. 7, the top end 52 of the shaft 44 is solid and is pressure fitted into a hole in a bottom of the handle 42. The bottom end 54 of the shaft 44 is drilled out at the bottom end 54 to provide a cavity 56 having an open end 58 at the bottom of the shaft 44 and a closed end 60 inside the cavity 56. Also, there is a ball hole 62 thru the side of the shaft 44 in the area of the cavity 56. The cavity 56 is for receiving the spring 46, ball 48 and activation plunger 50, whereby the closed end 60 of the cavity 56 provides a contact surface for the spring 46. The activation plunger 50 is a cylinder having a top end 64 and a bottom end 66, as shown in FIGS. 6, 8. The activation plunger 50 is sized to slide inside the cavity 56. The activation plunger 50 includes a milled out area 68 near the top end 64 of the activation plunger 50. The milled out area 68 receives the ball 48 and includes an upper section 70 and lower section 72. The milled out area 68 is milled such that the ball 48 can ride between the upper and lower sections 70, 72. The lower section 72 is closer to the top end 64 of the activation plunger 50 and has more material of the activation plunger 50 removed to accommodate more volume of the ball 48 than the upper section 70.

The spring 46, ball 48 and activation plunger 50 are assembled into the cavity 56 of the shaft 44 by first inserting the spring 46 into the open end 58 of the cavity 56 at the bottom end 54 of the shaft 44. Next, the activation plunger 50 is inserted into the open end 58 of the bottom end 54 of the shaft 44, top end 64 first. Once inserted, the milled out area 68 of the activation plunger 50 is aligned with the ball hole 62 and the ball 48 is then dropped into the ball hole 62, such that the ball 48 rides in the milled out area 68. The shaft 44 is then crimped at a top 74 and bottom 76 of the ball hole 62 to prevent the ball 48 from being removed from the ball hole 62, as shown in FIG. 6. With the ball 48 riding in the milled out area 68 and crimped in place, the ball 48 prevents the activation plunger 50 from falling from the cavity 56 of the shaft 44.

Figure 9:
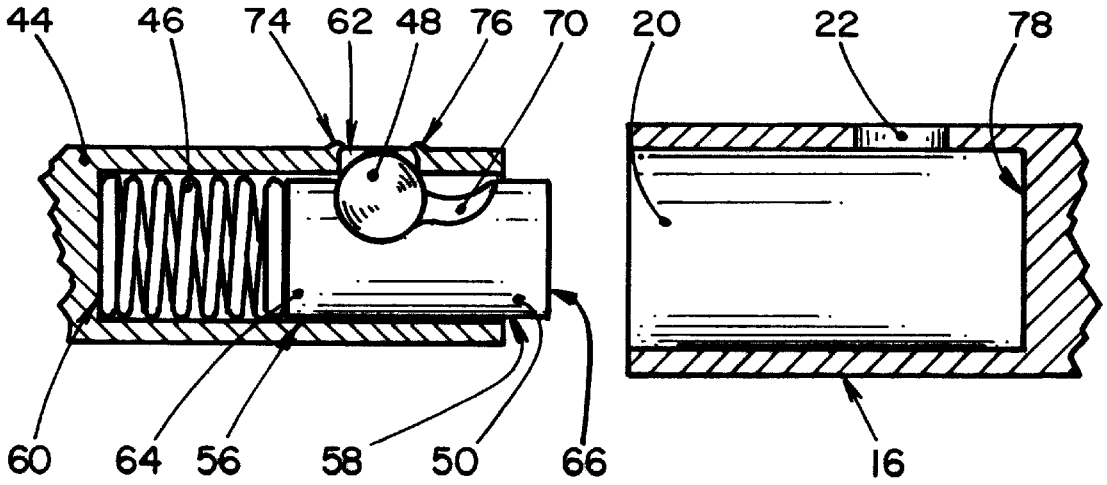
FIG. 9 is a cross-sectional view of a bottom end of the shaft and a head of the engagement means according to the present invention.
Figure 10:
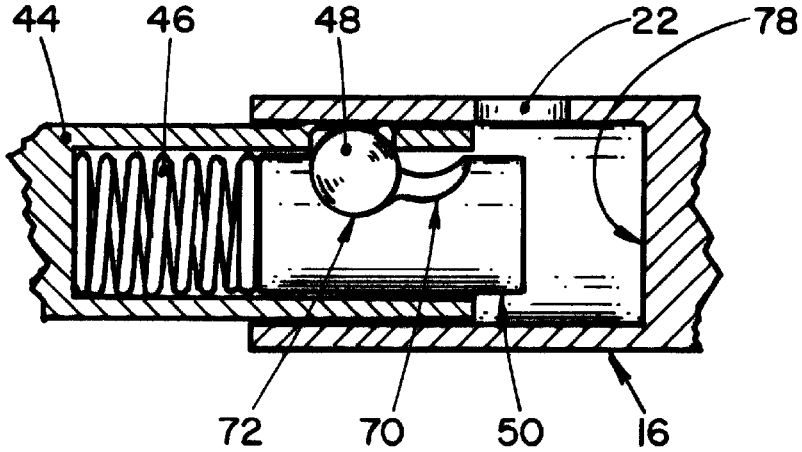
FIG. 10 is a cross-sectional view of the bottom end of the shaft entering the head of the engagement means according to the present invention.
Figure 11:
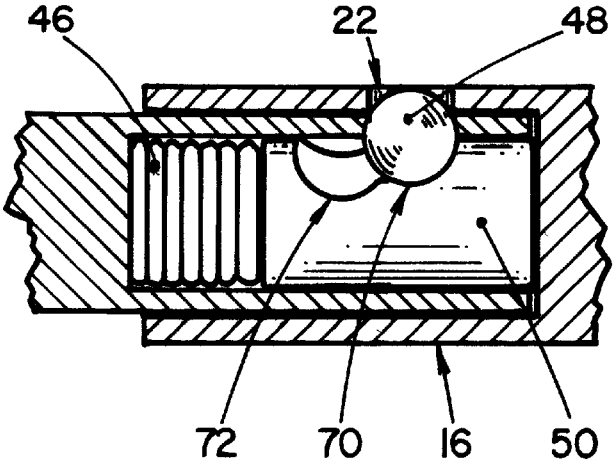
FIG. 11 is a cross-sectional view of the bottom end of the shaft engaging the head of the engagement means according to the present invention.
Figure 12:
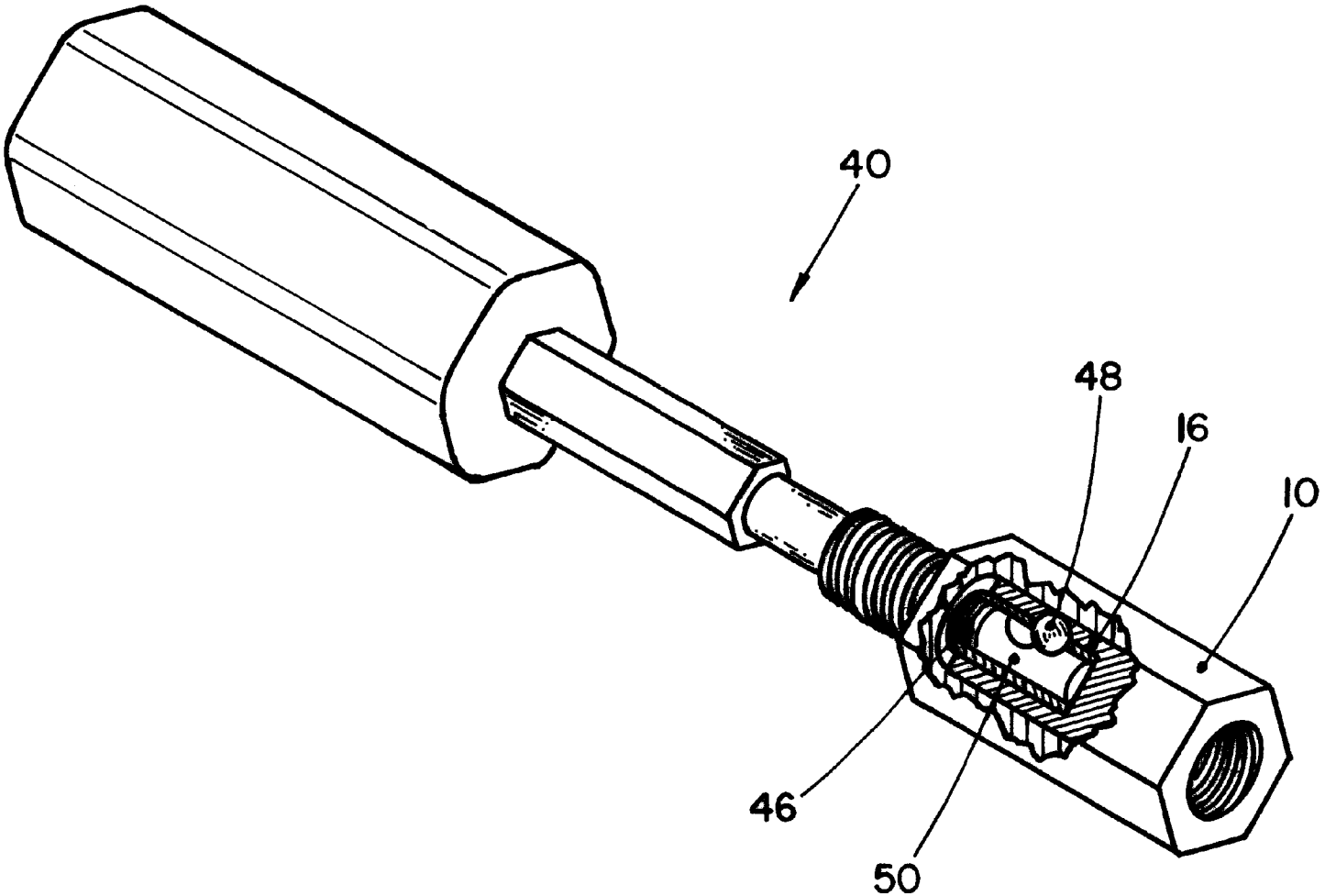
FIG. 12 is a perspective cut-a-way view of the tool according to the present invention engaged with the anti-tampering device of FIG. 1.
Figure 13:
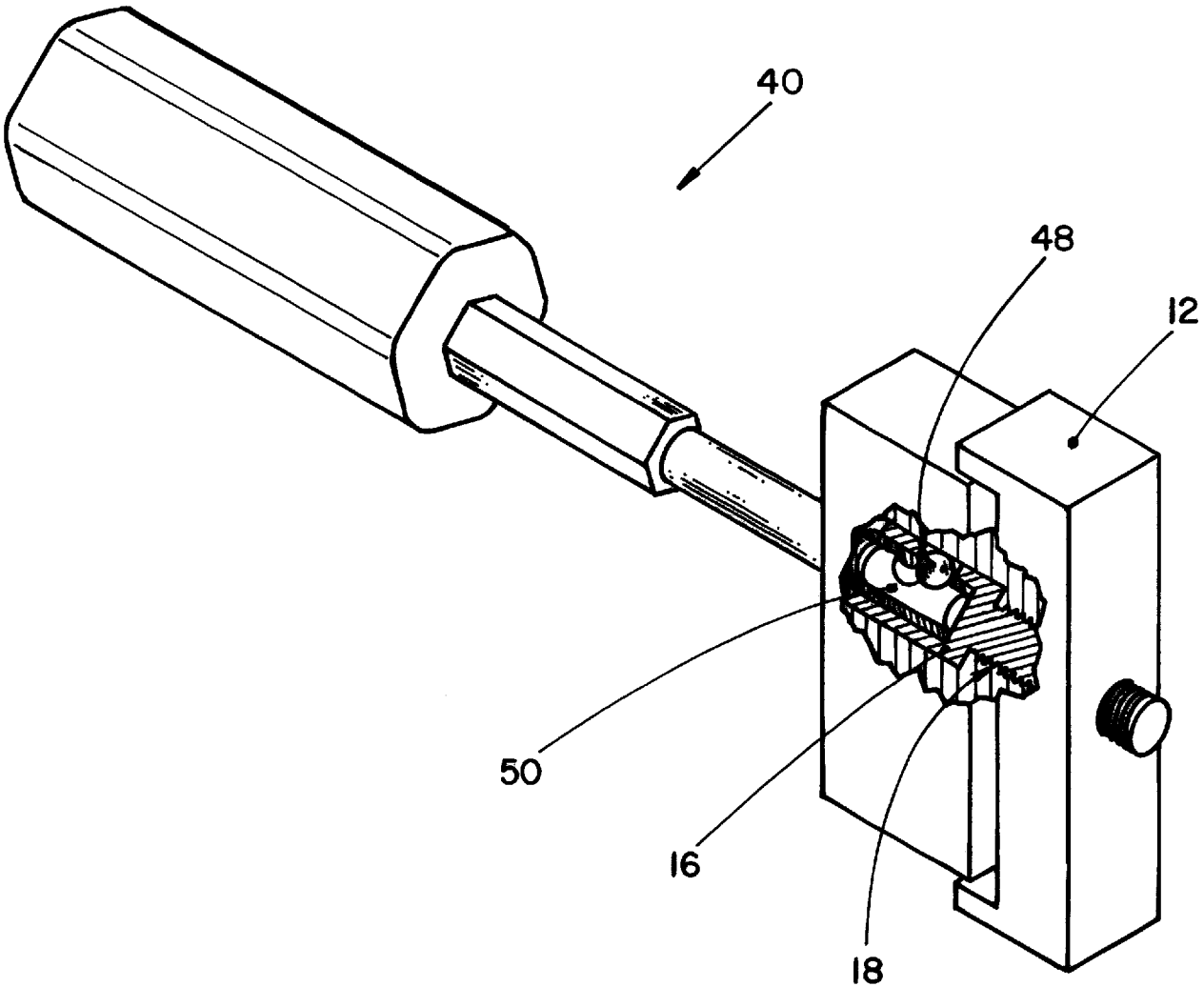
FIG. 13 is a perspective cut-a-way view of the tool according to the present invention engaged with the anti-tampering device of FIG. 2.

The tool 40 functions as follows. As shown in FIG. 9, when the tool 40 is in a rest configuration, the spring 46 forces the activation plunger 50 outward from the shaft 44. The activation plunger 50 is stopped from extending completely out of the shaft 44, when the ball 48 rides in the lower section 72 of the milled out area 68. In the rest configuration, the ball 48 does not extend past the outside diameter of the shaft 44 at the ball hole 62. When the tool 40 is being used with an anti-tampering device 10, 12, the bottom end 54 of the shaft 44 is inserted into the socket of the head 16 of the engagement means 14, as shown in FIG. 10. As the tool 40 is inserted into the socket, the activation plunger 50 is pushed into the cavity 56 of the shaft 44 when the activation plunger 50 contacts a bottom surface 78 of the socket, as shown in FIG. 11. During movement of the activation plunger 50, the ball 48 rides into the upper section 70 of the milled out area 68. Due to the movement of the ball 48 into the upper section 70, a portion of the ball 48 is forced out the ball hole 62. The ball 48 is forced into the ball hole 62 because the upper section 70 is not milled as deeply and accommodates less volume of the ball has less room to hold the ball 48 in place. With pressure on the tool 40, the tool 40 is rotated until the portion of the ball 48 extending from the ball hole 62 engages the hole 22 of the head 16 of the engagement means 14. Once the portion of the ball 48 engages the hole 22 of the head 16, the tool 40 is rotated under pressure to rotate the engagement means 14, in order to engage or disengage the body 18 to or from the other components of the anti-tampering devices 10, 12. FIGS. 12–13 show the tool 40 being used in the examples given for anti-tampering devices 10, 12.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

What is claimed is:

1. A tool, for use with anti-tampering devices, comprising:

a handle;

a shaft extending from said handle and having a bottom end opposite said handle;

a cavity in said shaft having an open end, said open end at said bottom end of said shaft;

a ball hole on said shaf within an area of said cavity;

an activation pluer inside said cavity and extending from said bottom end of said shaft;

a spring inserted into said cavity before said activation plunger which biases the activation plunger outward from said bottom end; and a ball in said cavity, said ball positioned to be extendible out said ball hole.

2. The tool of claim 1, wherein said cavity has a closed end within said shaft to provide a contact surface for said spring.

3. The tool of claim 1, wherein said plunger includes a milled out area to receive said ball.

4. The tool of claim 3, wherein said milled out area includes a upper section and a lower section and wherein said lower section has more material of said activation plunger removed to accommodate more volume of said ball than said upper section.

5. The tool of claim 1, further including a crimped area on an outside surface of said shaft above said ball hole, a crimped area on an outside surface of said shaft below said ball hole, and wherein said crimped areas retain said ball in said shaft and near said ball hole and retain the activation plunger from falling out of said cavity due to interaction between said ball and said activation plunger.

6. The method of engaging a engagement means (14) of a anti-tampering device with a tool, wherein the engagement means (14) includes a head (16) having a socket and a hole in the head (16) in the area of the socket, and wherein the tool includes a handle, a shaft extending from the handle and having a bottom end opposite the handle, a cavity in the shaft having an open end, the open end at the bottom end of the shaft, a ball hole on said shaft within an area of the cavity, a spring inserted into the cavity, an activation plunger extending from said bottom end of said shaft, and a ball in the cavity positioned to be extendible out the ball hole, comprising:

inserting the bottom end of the tool and hence the activation plunger into the socket of the head (16) of the engagement means (14);

pressing the tool into the socket such that the activation plunger engages an inside surface of the socket which pushes the activation plunger inward into the cavity, such that the activation plunger forces a portion of the ball to extend out the ball hole;

rotating the tool so that the portion of the ball extending from the ball hole engages the hole of the head (16) of the engagement means (14); and rotating the tool after the ball engages the hole of the head (16) to rotate the engagement means (14).

7. The method of claim 6, wherein said tool is disengaged and removed from the engagement means (14) by releasing the pressure on the tool.

8. The method of claim 6, wherein the cavity has a closed end within the shaft.

9. The method of claim 6, wherein the plunger includes a milled out area to receive the ball.

10. The method of claim 6, wherein the milled out area includes a upper section and a lower section and wherein the lower section has more material of the activation plunger removed to accommodate more volume of the ball than the upper section.

11. The method of claim 6, further including a crimped area on the shaft above the ball hole, a crimped area on the shaft below the ball hole, and wherein the crimped areas retain the ball in the shaft and near the ball hole.

* * * * *